United States Patent [19]

Raghavan et al.

[11] 4,019,900

[45] Apr. 26, 1977

[54] HIGH STRENGTH OXIDATION RESISTANT NICKEL BASE ALLOYS

[75] Inventors: Mathur Raghavan; Eugene Shapiro, both of Hamden, Conn.

[73] Assignee: Olin Corporation, New Haven, Conn.

[22] Filed: Apr. 1, 1976

[21] Appl. No.: 672,664

[52] U.S. Cl. ..... 75/171; 148/2; 148/11.5 N; 148/12.7 N; 148/32; 148/32.5

[51] Int. Cl.[2] ..... C22C 19/05

[58] Field of Search ..... 75/170, 171; 148/2, 148/11.5 N, 12.7 N, 32, 32.5

[56] References Cited

UNITED STATES PATENTS 3,810,754 5/1974 Ford et al. ..... 75/171

*Primary Examiner*—R. Dean

*Attorney, Agent, or Firm*—Robert A. Dawson; Robert H. Bachman

[57] ABSTRACT

High strength oxidation resistant nickel base alloys are disclosed, said alloys consisting essentially of from 2 to 6% aluminum, 1 to 6% chromium, 0.5 to 4% silicon, 5 to 20% cobalt, 0.03 to 0.30% carbon, 0.005 to 0.25% magnesium, balance nickel. The alloys may optionally include 0.002 to 0.05% boron, 0.002 to 0.05% zirconium, up to 15% iron, up to 1% manganese and up to 1% of an element selected from the group consisting of Rare Earth elements. The alloys exhibit a high resistance to oxidation deterioration and good mechanical properties at elevated temperatures.

12 Claims, No Drawings

HIGH STRENGTH OXIDATION RESISTANT NICKEL BASE ALLOYS

BACKGROUND OF THE INVENTION

Nickel base alloys represent an important class of commercial alloys which are commonly used in applications where good mechanical properties are important, such as high temperature strength and corrosion resistance. The art has long sought and continues to actively seek new and improved nickel base alloys where the properties of high temperature strength and corrosion resistance are improved, together with improvement of other mechanical properties such as hot workability, creep resistance and high creep rupture strength.

Typical nickel alloys such as Monel (70% by weight nickel, 30% by weight copper) are found to be highly susceptible to high temperature corrosin known as oxidation when exposed to high temperature gases containing oxygen. The mechanism of the oxidation attack is an intergranular one and the affected alloys often crumble apart. It is obviously highly desirable to provide improved nickel base alloys having good oxidation resistance as well as high temperature strength and corrosion resistance.

In accordance with U.S. Pat. No. 3,810,754 a series of oxidation resistant nickel base alloys are provided. It is desirable to maintain the oxidation resistance of this family of alloys while providing still further improvements in mechanical properties such as hot tensile strength, creep resistance and high creep rupture strength.

SUMMARY OF THE INVENTION

The improved oxidation resistant nickel base alloys of the present invention consist essentially of from 2 to 6% by weight aluminum, 1 to 6% by weight chromium, 0.5 to 4% by weight silicon, 5 to 20% by weight cobalt, 0.03 to 0.30% by weight carbon, 0.005 to 0.25% by weight magnesium, balance nickel. The alloys of the present invention may optionally include 0.002 to 0.05% by weight boron, 0.002 to 0.05% by weight zirconium, up to 15% by weight iron, up to 1% by weight manganese and up to 1% by weight of an element selected from the group consisting of Rare Earth elements.

It has been found that the nickel base alloys of the present invention have very high resistance to deterioration under oxidation conditions at elevated temperatures. This resistance to high temperature oxidation renders the alloys of the present invention highly desirable in certain high temperature applications, such as automotive exhaust systems, catalytic converters, certain portions of jet engines and certain components in chemical process plants. In addition, the improved nickel base alloys of the present invention have been found to possess a surprisingly good combination of mechanical properties which render them especially suitable for a variety of applications, for example, the alloys have excellent hot workability, good creep resistance and high creep rupture strength.

It is, therefore, a primary object of the present invention to provide improved nickel base alloys having extremely high resistance to oxidation corrosion at elevated temperatures.

It is a further object of the present invention to provide improved nickel base alloys as aforesaid having a surprisingly good combination of mechanical properties.

It is a still further object of the present invention to provide improved nickel base alloys as aforesaid characterized by relatively low cost and ease of manufacture.

DETAILED DESCRIPTION

The alloys of the present invention achieve a surprising combination of high temperature corrosion resistance under oxidation conditions coupled with a combination of excellent mechanical properties through the careful selection of alloying ingredients. Each of the alloying elements used in the alloys of the present invention contribute to the improvement of mechanical properties and corrosion resistance over that of pure nickel. This is achieved in part by selecting the alloying additions so that each alloying addition effectively decreases the stacking fault energy of the alloy, thereby affecting the dislocation behavior of the alloy and its mechanical strength as discussed in detail in the aforesaid U.S. Pat. No. 3,810,754. The alloying constituents also form complex oxides on the surface of the alloy at elevated temperatures. These oxides may be controlled and may be made extremely protective to the surface of the alloy by carefully controlling the concentration of the solute additions which form the oxides.

The outstanding properties of the alloys of the present invention are further obtained by decreasing the solubility of the gamma prime phase in the gamma phase of the alloy. This alloy system consists of a duplex gamma (matrix) plus a gamma prime (precipitate) phase system whose elevated temperature mechanical properties are enhanced by the volume fraction and stability of the gamma prime precipitate at the test temperature. The increased stability which results by decreasing the solubility of the gamma prime phase in the gamma phase may be accomplished by alloying additions such as cobalt and optionally iron.

The increased creep rupture strength of the instant alloy system is generally accomplished by increasing the stability of the gamma prime precipitates at elevated temperature, stabilizing the grain boundaries against deformation by precipitation of carbides at the grain boundaries and by the addition of trace elements such as boron and zirconium to the alloy system. The increased stability of the gamma prime precipitates at elevated temperature also improves the elevated temperature tensile strength of the alloy system.

In accordance with the present invention, nickel base alloys are provided containing from 2 to 6% by weight aluminum, 1 to 6% by weight chromium, 0.5 to 4% by weight silicon, 5 to 20% by weight cobalt, 0.03 to 0.30% by weight carbon, 0.005 to 0.25% by weight magnesium, balance nickel. The alloys of the present invention may optionally include 0.002 to 0.05% by weight boron, 0.002 to 0.05% by weight zirconium, up to 15% by weight iron, up to 1% by weight manganese and up to 1% by weight of an element selected from the group consisting of Rare Earth elements. Surprisingly, the alloys of the present invention achieve a combination of strength mechanisms while maintaining outstanding oxidation resistance.

The preferred composition ranges of the alloying additions are 3.3 to 4.5% by weight aluminum, 4 to 5% by weight chromium, 1.5 to 2.5% by weight silicon, 8 to 20% by weight cobalt, 0.08 to 0.20% by weight carbon, 0.01 to 0.15% by weight magnesium, balance nickel.

The boron and zirconium additions are preferably made to the alloy in the range of 0.002 to 0.015% by weight for each element.

The combination of strength and oxidaton resistance exhibited by the alloy system of the instant invention is achieved in part by using chromium carbide precipitation along with gamma prime hardening and cobalt solid solution hardening in the alloy system. The chromium content of the alloy matrix should be carefully controlled to avoid surface chromium oxide formation at elevated temperatures. Unique to this alloy system, therefore, is the ability of the system to form chromium carbide, particularly at grain boundaries to provide strength at elevated temperatures without sacrificing oxidation resistance. The amount of chromium vis-a-vis carbon should be controlled so as to prevent excessive loss of chromium in solid solution in the gamma phase as a result of the formation of the complex carbide, $Cr_{23}C_6$. An excessive decrease in the amount of chromium retained in solid solution in the gamma phase would significantly impair the oxidation resistance of the alloy system. Since the chromium carbide precipitate is desirable, the presence of other strong carbide formers such as titanium, vanadium, niobium, tungsten and molybdenum should be avoided in the instant alloy system. Any one of these additional carbide formers should be present in amounts less than 0.01% by weight and the total of all undesirable carbide formers should be less than 0.03% by weight in the alloy system. The source of these additional carbide formers depends upon the original source of supply of the alloying ingredients. Careful control of said supply should be exercised to minimize the presence of the carbide formers other than chromium, as indicated above. The limits imposed upon chromium and carbon in this alloy system ensure the outstanding oxidation performance of the alloy system at elevated temperatures.

The alloys of the present invention may be cast by any conventional means, including DC or book mold casting.

The alloys of the present invention may be readily processed into desirable wrought products. The cast alloys may be hot rolled at a temperature of at least 1600° F (871.1° C) and generally below 2200° F (1204.4° C), preferably 1900° to 2000° F (1037.8° to 1093.3° C), following a homogenization treatment in the same broad temperature range for 30 minutes to 24 hours. The preferred homogenization treatment is accomplished at a temperature range of 1900 to 2000° F (1037.8° to 1093.3° C) for 30 minutes to 3 hours. The hot rolling generally results in a 10 to 20% reduction for each hot rolling pass down to a final thickness suitable for cold rolling. If required, surface preparation of the alloy by any conventional means such as sandblasting, pickling or milling can be employed. The hot rolling may be accomplished in a plurality of passes, with the alloy being reheated at least once during the hot rolling process.

The hot rolled alloy may then be cold rolled to the desired gage with intermediate anneals. Cold rolling between anneals should accomplish a reduction of 50 to 80% in the alloy. Bell anneals may be utilized as the intermediate anneals at temperatures from 1500° to 2000° F (815.5 to 1093.3° C) for 30 minutes to 8 hours. These intermediate Bell anneals are preferably performed at 1800° to 1900° F (982.2° to 1037.8° C) for 1 to 3 hours. Strip annealing is recommended for the intermediate anneals. Strip annealing parameters should be adjusted to provide a substantially recrystallized structure and to minimize the formation and growth of the gamma prime phase in the gamma matrix upon cooling of the alloy to room temperature.

In order for the alloy to obtain maximum elevated temperature mechanical properties, the alloy should be subjected to a solution treatment and aging procedure. Any one of three methods is preferred for the solution treatment and aging steps. These methods include: (1) Bell anneal to solutionize and then slow cooling to thus provide solution treatment and aging in one operation; (2) Bell anheal to solutionize, cooling and finally Bell anneal at the aging temperature; (3) strip anneal at solutionizing temperature to effect the solution treatment of the carbides and gamma prime precipitate, then Bell anneal to age. The solution treatment of the first two methods (utilizing Bell anneal for solutionizing) should be accomplished at 1800° to 2200° F (982.2° to 1204.4° C) for 30 minutes to 8 hours, preferably at 1900° to 2000° F (1037.8° to 1093.3° C) for 1 to 3 hours. This effects a dissolution of the gamma prime and carbide phases in the gamma matrix. The solution treatment is preferably performed using a strip anneal, whose parameters are adjusted to obtain the desired effect in the alloy system. The solution treated alloy material is subjected to an aging treatment of 1300° to 1700° F (704.4° to 926.7° C) for 30 minutes to 16 hours. This aging is preferably performed at 1500° to 1600° F (815.5° to 871.1° C) for 1 to 4 hours.

The present invention will be more readily understood from a consideration of the following illustrative examples wherein all percentages are weight percentages.

EXAMPLE I

Three 10 lb. ingots identified as Alloys A59, A60 and A61 having the compositions set forth in Table I, were melted and cast.

TABLE I

Alloy Compositions

| Alloy | Composition, % | | | | | | | | | |
|---|---|---|---|---|---|---|---|---|---|---|
| | Ni | Al | Cr | Si | Mg | Co | Fe | C | Zr | B |
| A59 | Bal. | 3.5 | 3.6 | 2.1 | 0.03 | 9 | — | 0.125 | — | — |
| A60 | Bal. | 3.9 | 3.6 | 2.1 | 0.03 | 10 | 10 | 0.105 | 0.01 | 0.01 |
| A61 | Bal. | 3.9 | 4.0 | 2.1 | 0.04 | 10 | — | 0.100 | 0.01 | 0.01 |

All three alloys were homogenized in an exothermic gas atmosphere at 2000° F (1093.3° C) for 3 hours and hot rolled from the same temperature with a 0.25 inch reduction pass with a 5 minute reheat after every pass to a final gage of 0.25 inch. Small sections of the hot rolled plates were cold rolled to various final gages, depending upon the tests required, with two intermediate anneals at 1800° F (982.2° C) for 1 hour followed by fast (air) cooling. The gages for the intermediate anneals were 0.15 inch and 0.075 inch, respectively. Material intended for elevated temperature tensile testing was cold rolled to a final gage of 0.06 inch, for creep rupture testing to a final gage of 0.04 inch and for oxidation testing to a final gage of 0.015 inch.

EXAMPLE II

The specimens of Alloys A59, A60, and A61, as prepared in Example I, were cold rolled to a gage of 0.015 inch. These specimens were subjected to oxidation testing at a temperature of 1800° F (982.2° C) in a 1% oxygen, 10% water, 89% nitrogen atmosphere. The testing consisted of exposure of the specimens to the aforesaid temperature for 3 hours followed by a rapid cooling to room temperature, then followed by holding the specimens for 1 hour at room temperature and repeating the entire cycle. Weight gain of each specimen was computed after each cycle. The specimens were subjected to this testing up to 90 hours. This testing simulates the environment of a NO-hd x catalyst device and illustrates the effectiveness of the alloys of the present invention in such an environment. The oxidation behavior of the alloys of Example I was compared to that of the following commercial oxidation resistant nickel base alloys, identified as Alloys B, C and D, with the compositions of each set forth in Table II below.

TABLE II

Alloy Compositions

| Alloy | Composition, % Chromium | Silicon | Aluminum | Iron | Nickel |
|---|---|---|---|---|---|
| B | 19.6 | 1.25 | — | — | Essentially Balance |
| C | 16.5 | 1.20 | — | 13.0 | Essentially Balance |
| D | 23.0 | 0.25 | 1.35 | 14.1 | Essentially Balance |

These commercially available materials were subjected to the same oxidation testing as the alloys of Example I. The comparative data are shown in Table IIa below.

TABLE IIa

Oxidation Data

| Time, Hours | Weight Gain, mg/cm² A59 | A60 | A61 | B | C | D |
|---|---|---|---|---|---|---|
| 20 | 0.270 | 0.285 | 0.235 | 0.280 | 0.460 | 0.570 |
| 40 | 0.360 | 0.320 | 0.320 | 0.355 | 0.575 | 0.770 |
| 60 | 0.440 | 0.350 | 0.395 | 0.410 | 0.670 | 0.910 |
| 80 | 0.500 | 0.370 | 0.440 | 0.450 | 0.750 | 1.250 |
| 90 | 0.520 | 0.380 | 0.455 | 0.650 | 0.785 | 1.750 |

As can be seen from the data presented in Table IIa, the alloys of the present invention exhibit a higher degree of resistance to oxidation than commercially available Alloys B, C and D normally used for oxidation resistance properties. The superiority of the alloys of the present invention is clearly demonstrated at increasing times of exposure to the oxidation atmosphere. This indicates that the alloys of the present invention exhibit a greater lifespan than the commercial alloys normally utilized for this purpose.

EXAMPLE III

Alloy A61 was heat treated to maximum hardness by subjecting the alloy to a solutionizing temperature of 2000° F (1093.3° C) for 1 hour, cooling the alloy in air, aging the alloy at an annealing temperature of 1500° F (815.5° C) for 4 hours and finally cooling the alloy in air. The treated alloy contained a grain boundary carbide network and gamma prime precipitates within the gamma matrix. The high temperature tensile strength of Alloy A61 was recorded at different test temperatures up to 1800° F (982.2° C). For the purpose of comparison, elevated temperature strengths of commercial alloys known for their high tensile strength, termed Alloys E and F, were also recorded. The compositions of Alloys E and F are set forth in Table III below.

TABLE III

Alloy Compositions

| Alloy | Composition, % Cr | Fe | Si | C | Mn | Mo | Co | Cu | V | Ni |
|---|---|---|---|---|---|---|---|---|---|---|
| E | 15.5 | 8.0 | 0.25 | 0.08 | 0.5 | — | — | 0.25 | — | Bal. |
| F | 1.0 | 5.5 | 1.0 | 0.05 | 1.0 | 28 | 2.5 | — | 0.4 | Bal. |

The comparative elevated temperature tensile data are presented in Table IIIa.

TABLE IIIa

Elevated Temperature Tensile Strength Data

| Temperature, ° F | Tensile Strength, ksi A61 | E | F |
|---|---|---|---|
| 400 | 156 | 90 | 123 |
| 600 | 154 | 91 | 118 |
| 800 | 147 | 88 | 111 |
| 1000 | 132 | 83 | 101 |
| 1200 | 112 | 65 | 92 |
| 1400 | 89 | 27 | 70 |
| 1600 | 52 | 15 | 60 |
| 1800 | 8 | 7 | * |

*Reading not taken

As can be seen from the data presented in Table IIIa, Alloy A61 has superior tensile strength values up to 1600° F when compared to commercial Alloys E and F. The tensile strength values of Alloys A61 and E are roughly comparable at 1800° F. The performance of Alloy A61 indicates that the alloys of the present invention can exhibit tensile strength values at least as good as alloys commercially known for high tensile strength, without the expense of high percentages either of chromium (as in Alloy E) or molybdenum (as in Alloy F).

EXAMPLE IV

Alloy A61 was heat treated at a solutionizing temperature of 2000° F (1093.3° C) for 1 hour, air cooled, aged (annealed) at 1500° F (815.5° C) for 4 hours and finally air cooled. Creep rupture tests were performed on the heat treated samples A61 and Alloys E and F from Example III. Two test temperatures, 1000° F and 1500° F, were selected and stress levels were chosen to obtain a reasonable comparison of the performance of Alloy A61 and the two commercial alloys. Table IV lists the time to failure of Alloys A61, E and F at the different stress levels.

TABLE IV

Creep Rupture Performance

| Test Stress ksi | Test Temperature ° F | Time to Failure, hours A61 | E | F |
|---|---|---|---|---|
| 70 | 1000 | 850 | 10 | NA |
| 60 | 1000 | >1000 | 30 | NA |
| 20 | 1500 | 16 | — | 25 |
| 15 | 1500 | NA | — | 200 |
| 10 | 1500 | 400 | 100 | 1000 |

NA = Not Available

As can be seen from the values presented in Table IV, Alloy A61 is clearly superior to Alloy E in resisting creep rupture failure. At higher temperatures, Alloy A61 more closely approaches the performance of Alloy F, without the expense of the high percentage of molybdenum present in Alloy F.

The alloys of the present invention exhibit not only outstanding oxidation resistance but also excellent elevated temperature mechanical properties. The oxidation resistance and mechanical properties are especially important in high temperature applications.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A nickel base alloy having high resistance to oxidation at elevated temperatures, good hot workability, good creep resistance, good high temperature mechanical properties and high creep rupture strength, said alloy consisting essentially of from 2 to 6% by weight aluminum, 1 to 6% by weight chromium, 0.5 to 4% by weight silicon, 5 to 20% by weight cobalt, 0.03 to 0.30% by weight carbon, 0.005 to 0.25% by weight magnesium, balance nickel.

2. An alloy according to claim 1 including 0.002 to 0.05% by weight boron and 0.002 to 0.05% by weight zirconium.

3. An alloy according to claim 2 including up to 15% by weight iron.

4. An alloy according to claim 2 including up to 1% by weight manganese.

5. An alloy according to claim 2 including up to 1% by weight of an element selected from the group consisting of Rare Earth elements.

6. An alloy according to claim 1 wherein said alloy consists of a duplex gamma matrix plus a gamma prime precipitate phase system.

7. An alloy according to claim 1 wherein said alloy contains a dispersed chromium carbide phase preferably at the grain boundaries of the alloy.

8. An alloy according to claim 1 wherein said alloy consists essentially of from 3.3 to 4.5% by weight aluminum, 4 to 5% by weight chromium, 1.5 to 2.5% by weight silicon, 8 to 20% by weight cobalt, 0.08 to 0.20% by weight carbon, 0.01 to 0.15% by weight magnesium, balance nickel.

9. An alloy according to claim 2 wherein said boron and said zirconium are present in the alloy in the range of 0.002 to 0.015% by weight for each element.

10. A method of preparing a wrought nickel base alloy comprising:

A. providing a nickel base alloy consisting essentially of from 2 to 6% by weight aluminum, 1 to 6% by weight chromium, 0.5 to 4% by weight silicon, 5 to 20% by weight cobalt, 0.03 to 0.30% by weight carbon, 0.005 to 0.25% by weight magnesium, balance nickel;

B. hot rolling said alloy at a temperature of at least 1600° F;

C. cold rolling said alloy to a desired gage with intermediate annealing to provide a substantially recrystallized structure in the alloy system and to minimize the formation and growth of the gamma prime phase in the gamma matrix of the alloy upon cooling to room temperature;

D. subjecting said alloy to a solution treatment to effect the dissolution of the gamma prime and carbide phases in the gamma matrix of the alloy system; and E. aging said alloy at 1300° to 1700° F for 30 minutes to 16 hours.

11. A method according to claim 10 wherein prior to hot rolling the alloy is homogenized at a temperature from 1600° to 2200° F for 30 minutes to 24 hours.

12. A method according to claim 10 wherein said hot rollin is accomplished in a plurality of passes, with the material being reheated at least once during said hot rolling.

* * * * *